US010480794B2

(12) United States Patent
Cadima

(10) Patent No.: US 10,480,794 B2
(45) Date of Patent: Nov. 19, 2019

(54) COOKTOP APPLIANCE WITH A GAS BURNER ASSEMBLY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 45 days.

(21) Appl. No.: 15/678,155

(22) Filed: Aug. 16, 2017

(65) Prior Publication Data

US 2019/0056115 A1 Feb. 21, 2019

(51) Int. Cl.

| | |
|---|---|
| ***F24C 3/12*** | (2006.01) |
| ***F24C 3/08*** | (2006.01) |
| ***F23N 1/00*** | (2006.01) |
| ***F23N 1/04*** | (2006.01) |

(52) U.S. Cl.

CPC ..... *F24C 3/124* (2013.01); *F23N 1/007* (2013.01); *F23N 1/047* (2013.01); *F24C 3/082* (2013.01); *F24C 3/122* (2013.01); *F23N 2027/02* (2013.01); *F23N 2035/12* (2013.01); *F23N 2035/14* (2013.01)

(58) Field of Classification Search

None

See application file for complete search history.

(56) References Cited

U.S. PATENT DOCUMENTS

| | | | | |
|---|---|---|---|---|
| 2,916,022 | A * | 12/1959 | Arant | F23N 5/02 122/504 |
| 3,592,180 | A * | 7/1971 | Kweller | F23D 14/04 126/214 R |
| 5,857,262 | A * | 1/1999 | Bonnema | A45D 20/06 34/97 |
| 6,263,868 | B1 * | 7/2001 | Koch | F23D 14/06 126/39 E |
| 6,322,354 | B1 | 11/2001 | Carbone et al. | |
| 7,291,009 | B2 * | 11/2007 | Kamal | F23D 14/06 126/39 E |
| 8,479,721 | B2 | 7/2013 | Graham et al. | |
| 8,845,326 | B2 * | 9/2014 | Shaffer | F23D 14/06 126/39 E |
| 2004/0048216 | A1 | 3/2004 | Brown et al. | |

(Continued)

FOREIGN PATENT DOCUMENTS

| | | |
|---|---|---|
| CN | 1594975 B | 4/2010 |
| EP | 887590 A1 | 12/1998 |

(Continued)

*Primary Examiner* — Avinash A Savani
*Assistant Examiner* — Martha M Becton
(74) *Attorney, Agent, or Firm* — Dority & Manning, P.A.

(57) ABSTRACT

A gas burner assembly for a cooktop appliance includes a normally aspirated primary burner and a concentrically-positioned forced air boost burner. A dual-outlet control valve provides a flow of primary fuel to the primary burner through a first outlet and a flow of boost fuel to the boost burner through a second outlet. The boost burner operates by receiving the flow of boost fuel and a flow of combustion air from a forced air supply source only when the primary burner is operating in a low condition.

16 Claims, 5 Drawing Sheets

(56) References Cited

U.S. PATENT DOCUMENTS

| | | | | |
|---|---|---|---|---|
| 2006/0051718 | A1* | 3/2006 | Kamal | F23D 14/06<br>431/354 |
| 2013/0059256 | A1 | 3/2013 | Cadeau | |
| 2014/0048293 | A1 | 2/2014 | Luongo et al. | |
| 2014/0295357 | A1 | 10/2014 | McAfee et al. | |

FOREIGN PATENT DOCUMENTS

| | | | |
|---|---|---|---|
| EP | 2534421 | B1 | 3/2014 |
| JP | 3737184 | B2 | 1/2006 |
| JP | 2007057226 | A | 3/2007 |
| JP | 04595599 | B2 | 12/2010 |

* cited by examiner

COOKTOP APPLIANCE WITH A GAS BURNER ASSEMBLY

FIELD OF THE INVENTION

The present subject matter relates generally to cooktop appliances and more particularly to gas burner assemblies for cooktop appliances.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Normally aspirated gas burners rely on the energy available in the form of pressure from the fuel supplied to the gas burner to entrain air for combustion. Because the nominal pressure in households is relatively low, there is a practical limit to the amount of primary air a normally aspirated gas burner can entrain. Introducing a fan or another forced air supply into a gas burner assembly may improve the mixture of fuel and air for improved operation at higher outputs, with shorter flames and improved combustion, and with improved efficiency.

However, known gas burners with fans suffer several drawbacks. For example, forced air gas burners often require costly variable speed fans that vary with the fuel input to maintain a proper mixture of fuel and air. In addition, certain gas burners include multiple burner stages that compete for combustion air and cause operability issues. Such gas burners often require complex or costly control systems and/or flow regulators to achieve efficient combustion.

Accordingly, a cooktop appliance including an improved gas burner with forced aeration would be desirable. More particularly, a gas burner assembly with forced aeration that does not require a variable speed fan, costly valves, or a complex control system would be particularly beneficial.

BRIEF DESCRIPTION OF THE INVENTION

The present subject matter provides a gas burner assembly for a cooktop appliance including a normally aspirated primary burner and a concentrically-positioned forced air boost burner. A dual-outlet control valve provides a flow of primary fuel to the primary burner through a first outlet and a flow of boost fuel to the boost burner through a second outlet. The boost burner operates by receiving the flow of boost fuel and a flow of combustion air from a forced air supply source only when the primary burner is operating in a low condition. Additional aspects and advantages of the invention will be set forth in part in the following description, or may be apparent from the description, or may be learned through practice of the invention.

In a first example embodiment, a cooktop appliance is provided. The cooktop appliance includes a top panel and a gas burner assembly positioned at the top panel. The gas burner assembly includes one or more burner bodies defining a first plurality of flame ports, a first fuel chamber, a second plurality of flame ports, and a second fuel chamber, the first fuel chamber being in fluid communication with the first plurality of flame ports such that gaseous fuel within the first fuel chamber is flowable through the first plurality of flame ports, the second fuel chamber being in fluid communication with the second plurality of flame ports such that gaseous fuel within the second fuel chamber is flowable through the second plurality of flame ports, the first fuel chamber being separate from the second fuel chamber within the one or more burner bodies. A dual-outlet control valve includes a first outlet in fluid communication with the first fuel chamber for providing a first flow of the gaseous fuel and a second outlet in fluid communication with the second fuel chamber for providing a second flow of the gaseous fuel. The dual-outlet control valve is movable to a boost position where the first flow of gaseous fuel is provided to the first fuel chamber at a low flow rate and the second flow of gaseous fuel is provided to the second fuel chamber. A forced air supply source fluidly coupled to the second fuel chamber such that the forced air supply source is operable to urge a flow of air into the second fuel chamber only when the dual-outlet control valve is in the boost position.

In a second example embodiment, a gas burner assembly for a cooktop appliance is provided. The gas burner assembly includes a dual-outlet control valve for providing a flow of primary fuel out of a first outlet and a flow of boost fuel out of a second outlet. A first burner stage is normally aspirated and in fluid communication with the first outlet and a second burner stage is concentrically positioned adjacent the first burner stage and is in fluid communication with the second outlet. The flow of boost fuel is provided only when the dual-outlet control valve is in a boost position and when the first burner stage is operating in a low condition. A forced air supply source is fluidly coupled to the second burner stage such that the forced air supply source is operable to urge a flow of air into the second burner stage only when the flow of boost fuel is being provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
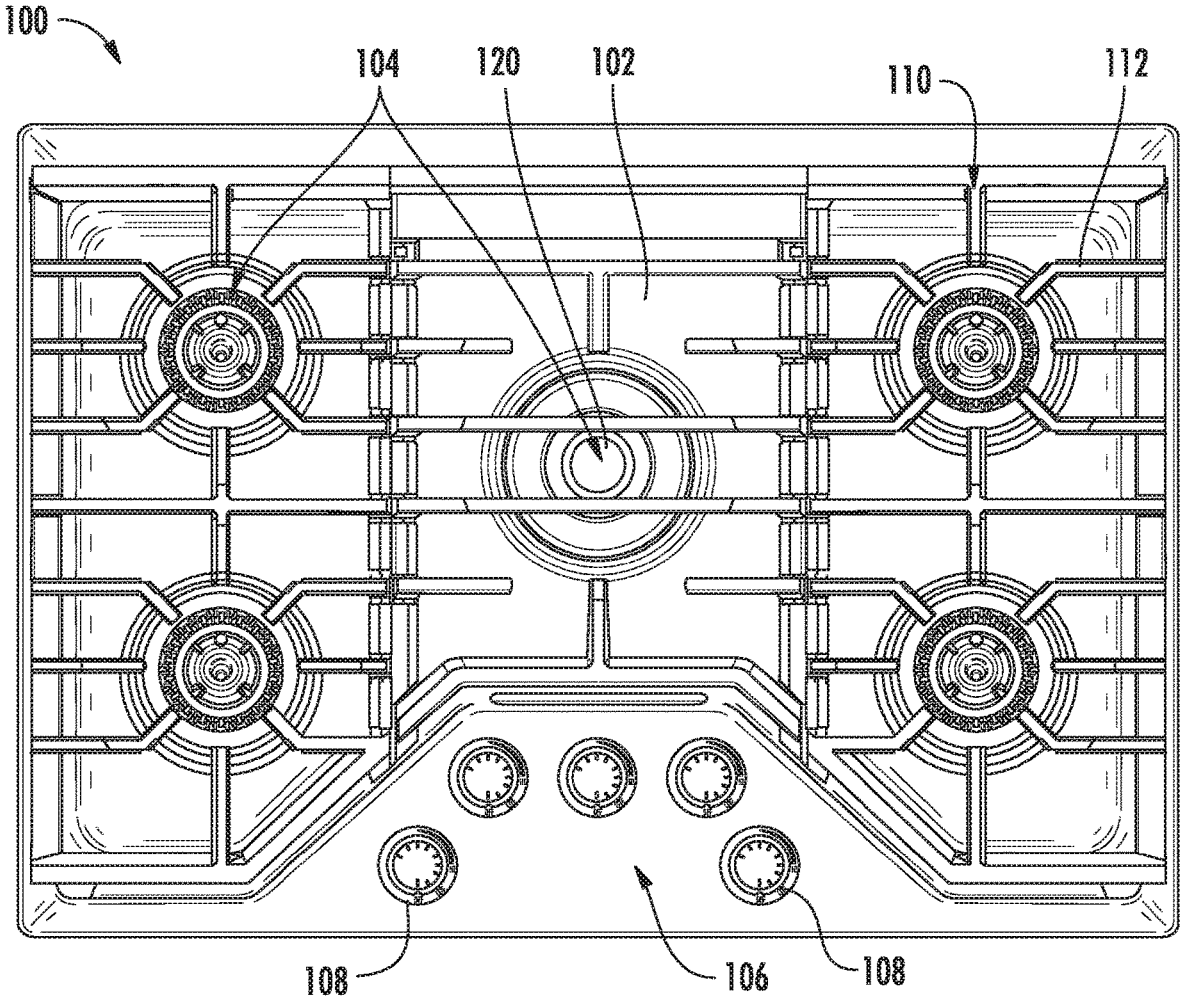
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

According to the illustrated embodiment, cooktop appliance 100 is a gas cooktop and heating elements 104 are gas burners, such as a gas burner assembly 120 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
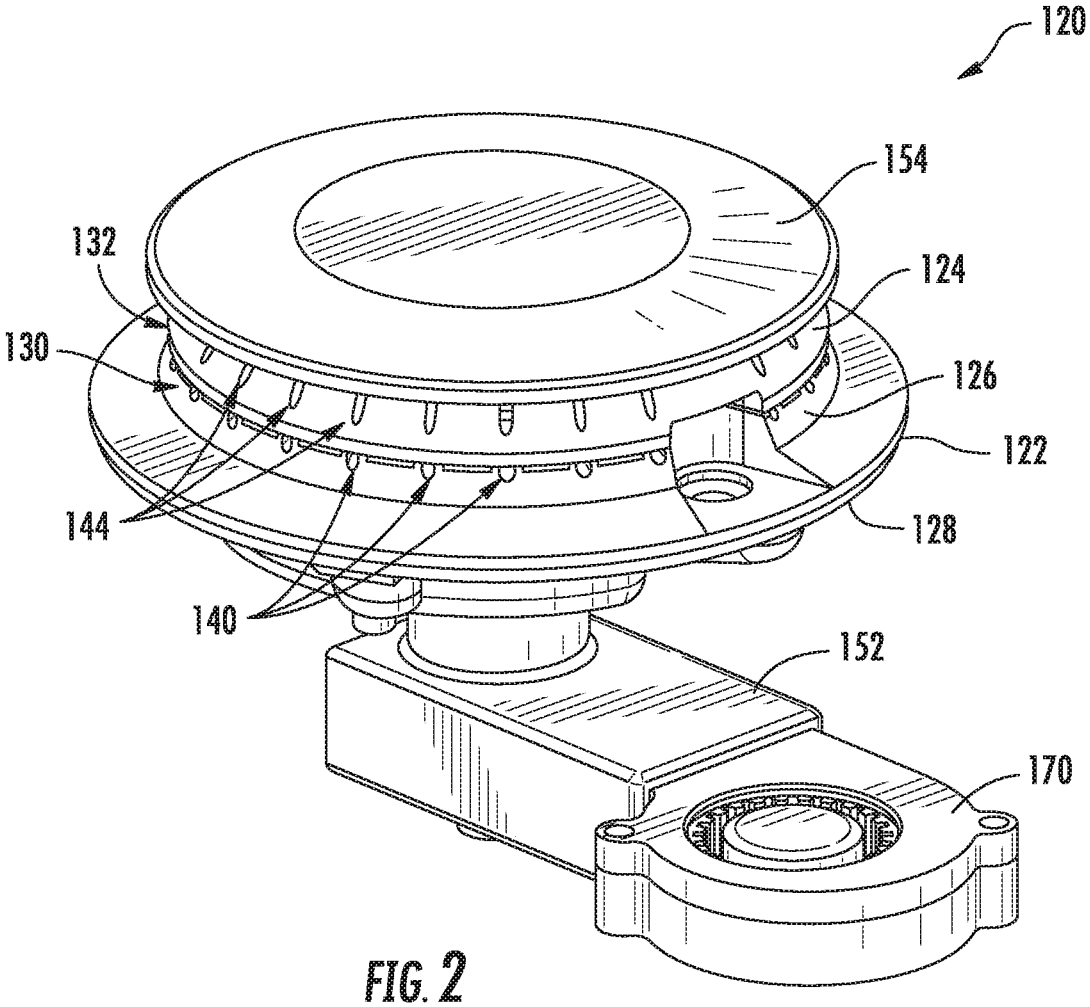
FIG. 2 provides a perspective view of a gas burner assembly of the exemplary cooktop appliance of FIG. 1 according to an exemplary embodiment of the present subject matter.
Figure 3:
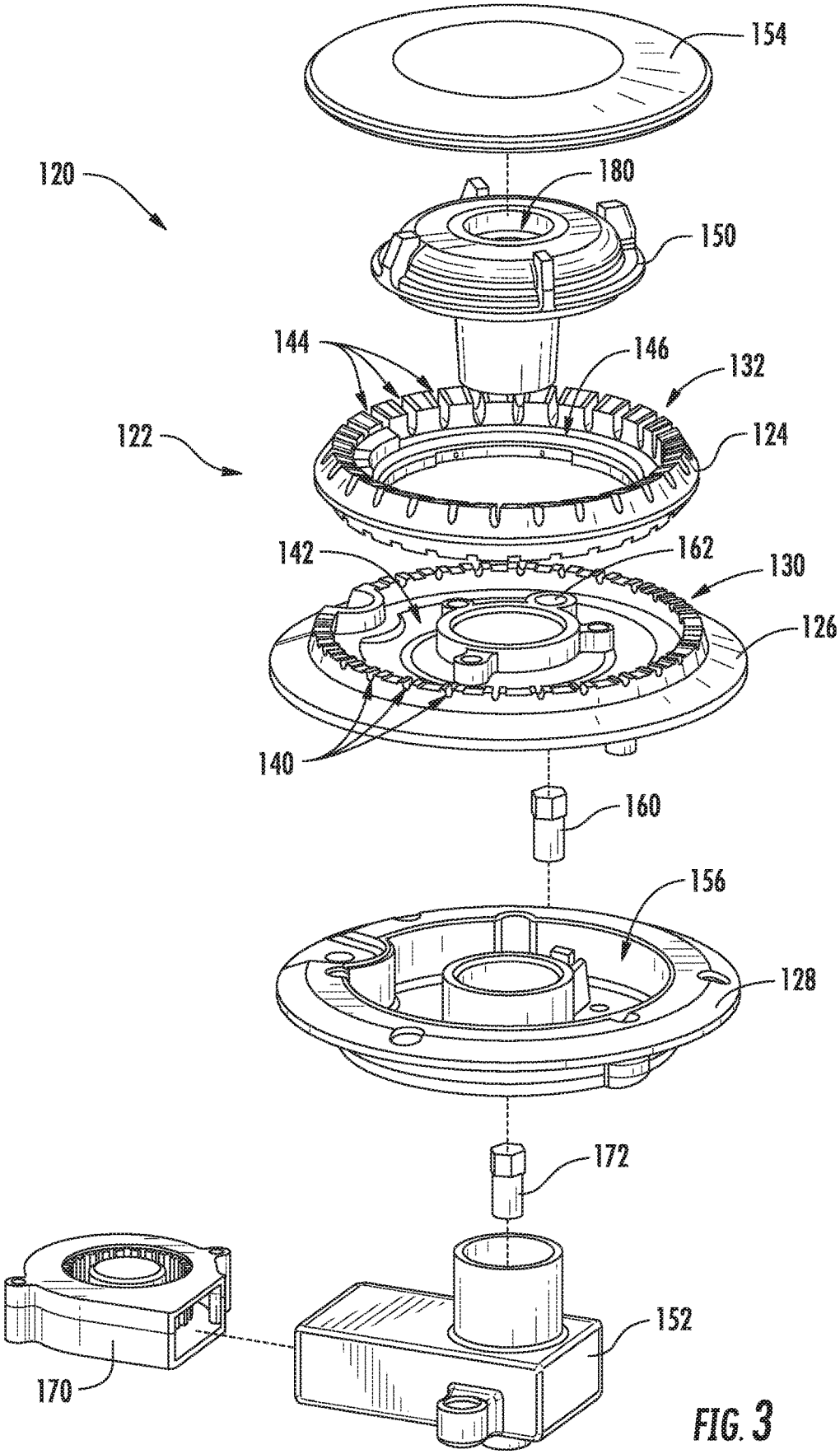
FIG. 3 is an exploded view of the example gas burner of FIG. 2.
Figure 4:
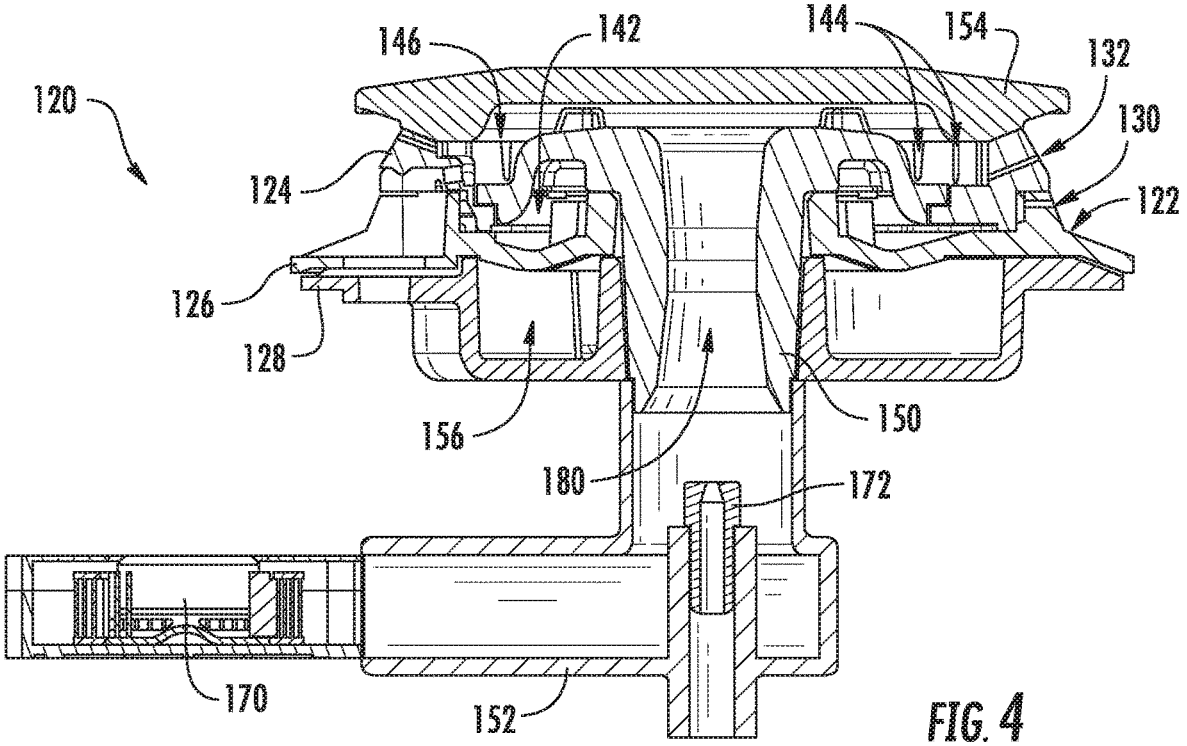
FIG. 4 is a section view of the example gas burner of FIG. 2.
Figure 5:
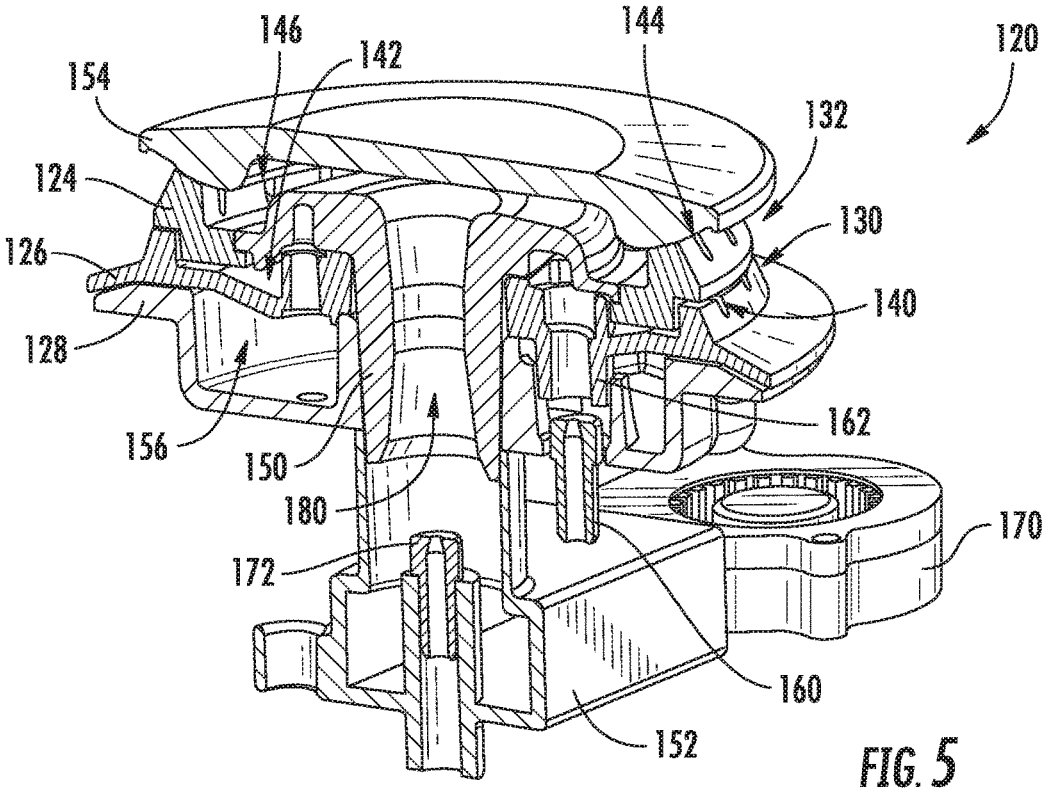
FIG. 5 is another section view of the example gas burner of FIG. 2.

FIG. 2 is a perspective view of gas burner assembly 120. FIG. 3 is an exploded view of gas burner assembly 120. FIG. 4 is a section view of the gas burner assembly 120, and FIG. 5 is another section view of gas burner assembly 120. As an example, burner assembly 120 may be used in cooktop appliance 100 (FIG. 1) as one of heating elements 104. However, it will be understood that, while described in greater detail below in the context of cooktop appliance 100, gas burner assembly 120 may be used in or with any suitable appliance in alternative example embodiments.

As may be seen in FIGS. 2 through 5, gas burner assembly 120 includes one or more burner bodies 122, which may include for example, a first burner body 124, a second burner body 126, and a third burner body 128. Burner bodies 122 generally define a first burner ring or stage 130 (e.g., a primary burner) and a second burner ring or stage 132 (e.g., a boost burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 120 may also include an air duct 150, a manifold 152, and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 120. Thus, first fuel chamber 142 is not in flow communication with second fuel chamber 146 within gas burner assembly 120. In addition, an air chamber 156 may be defined by second burner body 126 and third burner body 128.

According to the exemplary illustrated embodiment, first burner stage 130 is a normally aspirated burner that relies on the energy available in the form of pressure from the fuel supplied to the gas burner to entrain air for combustion. In this regard, for example, as best shown in FIGS. 3 and 5 a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

By contrast, second burner stage 132 is a forced air burner that uses supplemental air from a forced air supply source to facilitate combustion. In this regard, for example, as illustrated in FIGS. 2 through 5, the forced air supply source is provided by a fan 170. Although illustrated as fan 170, it should be appreciated that the forced air supply source may be any other device suitable for urging a flow of combustion air, such as an air compressor.

As illustrated, fan 170 is mounted directly to manifold 152. Thus, e.g., fan 170 is operable to urge air into manifold 152. A second orifice 172 is also mounted to manifold 152. Thus, gaseous fuel from second orifice 172 may flow into manifold 152 and mix with air from fan 170. Manifold 152 also extends to air duct 150. A passage 180 of air duct 150 extends from manifold 152 to second fuel chamber 146. Thus, the mixture of gaseous fuel and air from manifold 152 may flow through passage 180 of air duct 150 to second fuel chamber 146. Second orifice 172 may be positioned directly below and/or concentric with passage 180 of air duct 150. From second fuel chamber 146, the mixture of gaseous fuel and air may flow through and be combusted at second plurality of flame ports 144. Thus, second plurality of flame ports 144 are in fluid communication with second fuel chamber 146 such that the mixture of gaseous fuel and air within second fuel chamber 146 is flowable through second plurality of flame ports 144. As may be seen from the above, fan 170 may be coupled to gas burner assembly 120 such that fan 170 is operable to urge a flow of air into only second fuel chamber 146, and fan 170 may provide air to second fuel chamber 146 for forced aspiration of second burner stage 132.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when control knob 108 is in the boost position. For example, flames at first burner stage 130 may assist with lighting gaseous fuel at second burner stage 132 when control knob 108 is in the boost position due to the position of first burner stage 130 below second burner stage 132.

Figure 6:
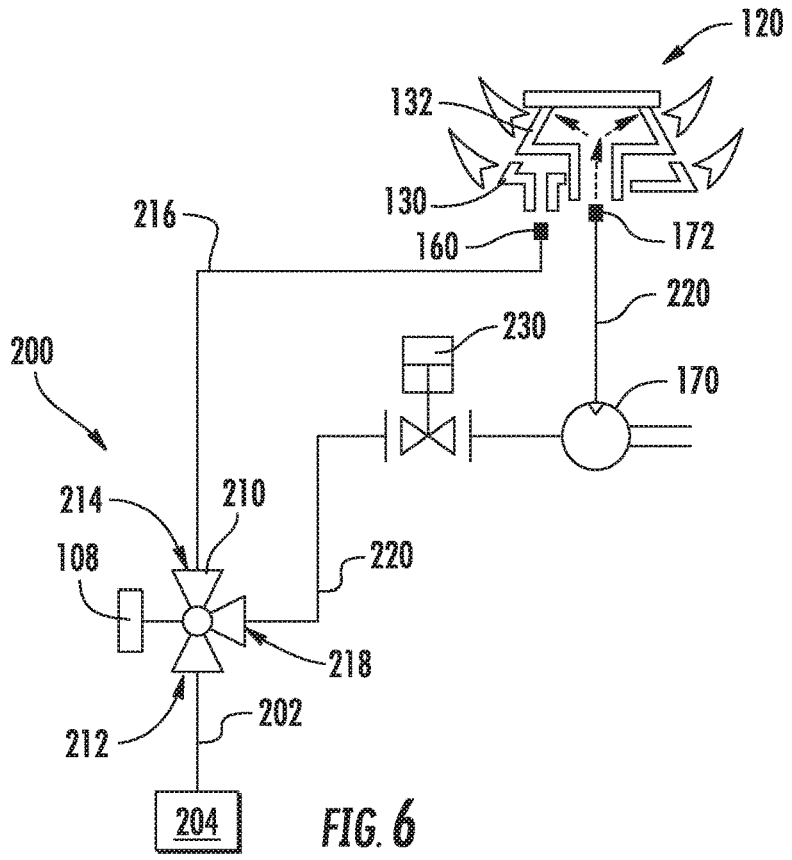
FIG. 6 is a schematic view of a gas burner assembly and a gaseous fuel supply circuit according to an example embodiment of the present subject matter.

Referring now to FIG. 6, a schematic view of gas burner assembly 120 and a gaseous fuel supply circuit 200 will be described. In general, gaseous fuel supply circuit 200 is configured for selectively supplying gaseous fuel such as propane or natural gas to first burner stage 130 and second burner stage 132 to regulate the amount of heat generated by the respective stages. In particular, gaseous fuel supply circuit 200 is configured for selectively supplying gaseous fuel to only first burner stage 130 or to both first and second burner stages 130, 132 depending upon the desired output of gas burner assembly 120 selected by a user of gas burner assembly 120. Thus, first burner stage 130 is separate or independent from second burner stage 132, e.g., such that first burner stage 130 is not in fluid communication with second burner stage 132 within gas burner assembly 120. In such manner, gaseous fuel within gas burner assembly 120 does not flow between first and second burner stages 130, 132.

As shown in FIG. 6, gaseous fuel supply circuit 200 includes a supply line 202 that may be coupled to a pressurized gaseous fuel source 204, such as a natural gas supply line or a propane tank. In this manner, gaseous fuel (e.g., natural gas or propane) is flowable from the pressurized gaseous fuel source 204 into supply line 202. Gaseous fuel supply circuit 200 further includes a dual-outlet control valve 210 operably coupled to supply line 202 for selectively directing a metered amount of fuel to first burner stage 130 and second burner stage 132. More specifically, dual-outlet control valve 210 includes an inlet 212 fluidly coupled with supply line 202, a first outlet 214 fluidly coupled with a first branch 216 and extending to first orifice 160, and a second outlet 218 fluidly coupled with a second branch 220 and extending to second orifice 172. Thus, supply line 202 is positioned upstream of first and second branches 216, 220 relative to a flow of gaseous fuel from fuel source 204, and first and second branches 216, 220 may be split off of supply line 202.

In operation, gaseous fuel from the supply line 202 may flow to first and second branches 216, 220. From first branch 216, the gaseous fuel may flow to first orifice 160. In this regard, first orifice 160 is positioned for directing gaseous fuel into gas burner assembly 120, or more particularly into first burner stage 130. Second orifice 172 is also positioned for directing gaseous fuel into gas burner assembly 120, or more particularly into second burner stage 132. Thus, first and second branches 216, 220 may separately supply the gaseous fuel from supply line 202 to first and second burner stages 130, 132.

Dual-outlet control valve 210 is coupled to supply line 202, e.g., upstream of first and second branches 216, 220. According to the illustrated embodiment, a solenoid valve 230 is coupled to second branch 220, e.g., upstream of second orifice 172. Thus, solenoid valve 230 may be positioned between supply line 202 and second orifice 172. Dual-outlet control valve 210 is selectively adjustable to regulate gaseous fuel flow through supply line 202 to first and second branches 216, 220. Solenoid valve 230 is selectively adjustable to allow gaseous fuel flow through second branch 220 to second orifice 172. For example, according to an exemplary embodiment, solenoid valve 230 is operably coupled to fan 170 and is configured to shut off the flow of fuel in second branch 220 in the event of a fan failure. In addition, solenoid valve 230 may be normally closed and openable in response to dual-outlet control valve 210 shifting to the boost position and to fan 170 activating. Thus, dual-outlet control valve 210 and solenoid valve 230 cooperate to regulate gaseous fuel flow to first and second burner stages 130, 132.

As illustrated, dual-outlet control valve 210 is coupled to control knob 108 to allow a user to regulate the flows of fuel to first burner stage 130 and second burner stage 132. Similarly, fan 170 may be either directly controlled by control knob 108 or may be controlled based on the amount of fuel supplied to obtain the desired air/fuel ratio for combustion. A user may rotate control knob 108 to adjust fuel flow through supply line 202 with dual-outlet control valve 210. In particular, gas burner assembly 120 may have a respective heat output at each position of control knob 108. It will be understood that while described herein in the context of the positions of control knob 108, the description also corresponds to the positions and/or configurations of dual-outlet control valve 210 for regulating operation of gas burner assembly 120.

Figure 7:
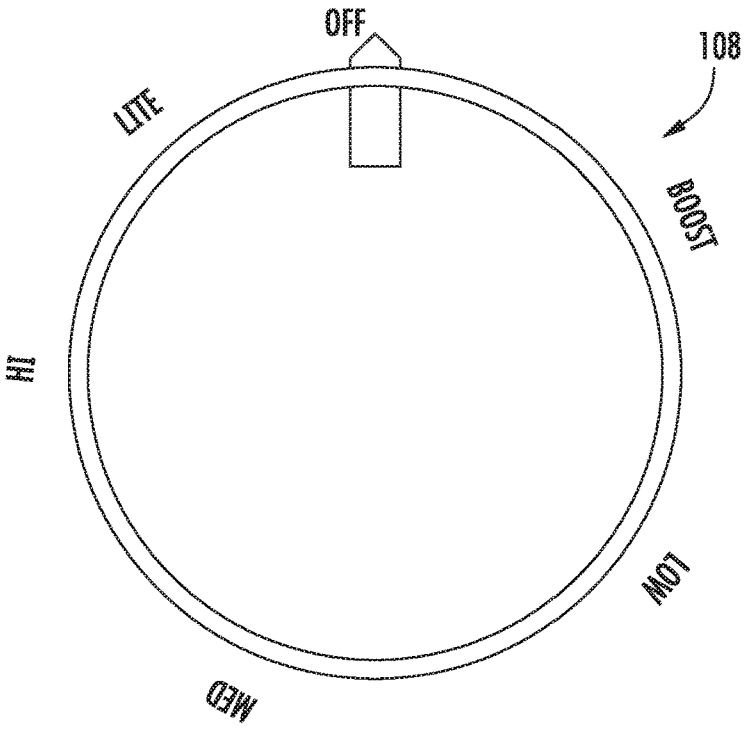
FIG. 7 is a front, elevation view of a knob of the example cooktop appliance of FIG. 1 and the example gaseous fuel supply circuit of FIG. 6.

Referring now also to FIG. 7, a front, elevation view of control knob 108 of gaseous fuel supply circuit 200 is provided. As shown, control knob 108 may be rotated counterclockwise between an off position, a lite position, a high position, a medium position, a low position, and a boost position. In the off position, dual-outlet control valve 210 blocks gaseous fuel flow through supply line 202 to first and second branches 216, 220. Thus, gas burner assembly 120 is not supplied with gaseous fuel from gaseous fuel supply circuit 200 when control knob 108 is in the off position. Conversely, when control knob 108 is in the lite position, gaseous fuel is supplied through first branch 216 only and is ignited in first burner stage 130, e.g., via a spark electrode (not shown).

As control knob 108 is progressively rotated counterclockwise, the flow rate of fuel provided to first burner stage 130 corresponds with the high position or a high flow rate, the medium position or a medium flow rate, and the low position or a low flow rate, e.g., the flow rate of gaseous fuel through dual-outlet control valve 210 decreases as control knob 108 rotates counterclockwise. In this manner, control knob 108 is used to control the heat output (e.g., in BTUs) of first burner stage 130. However, no fuel is provided to second burner stage 132 when control knob 108 is in the lite position, the high position, the medium position, or the low position. In this regard, for example, second outlet 218 of dual-outlet control valve 210 and solenoid valve 230 may be closed.

As described above, second burner stage 132 is not supplied with gaseous fuel from gaseous fuel supply circuit 200 when control knob 108 is in the off position, the lite position, the high position, the medium position, or the low position. However, when control knob 108 is in the boost position, dual-outlet control valve 210 permits gaseous fuel flow through supply line 202 to first and second branches 216, 220. Thus, first burner stage 130 is supplied with gaseous fuel from gaseous fuel supply circuit 200 when control knob 108 is in the boost position. In addition, solenoid valve 230 is open in the boost position. Thus, second burner stage 132 is supplied with gaseous fuel from gaseous fuel supply circuit 200 when control knob 108 is in the boost position.

Notably, however, when control knob 108 is in the boost position, dual-outlet control valve 210 regulates the flow of fuel in first branch 216 to a low flow rate. In addition, the flow of fuel may be provided through second branch 220 to second burner stage 132, e.g., at a high fixed rate. In this manner, first burner stage 130 may remain ignited and may serve as an ignition source for second burner stage 132. However, because first burner stage 130 is limited to a low flow rate, the flames from first burner stage 130 to not impede oxygen from reaching second burner stage 132 and facilitating improved combustion.

Referring again to FIG. 6, fan 170 is operable to flow air into second burner stage 132. In particular, fan 170 may be deactivated and not flow air into second burner stage 132 when control knob 108 is in the off position, lite position, the high position, the medium position, or the low position. However, fan 170 may be activated and urge air into second burner stage 132 when control knob 108 is in the boost position. In this regard, air from fan 170 may facilitate burning of gaseous fuel at second burner stage 132.

According to an exemplary embodiment, first burner stage 130 is a normally aspirated burner activated when control knob 108 is in the high position, the medium position, the low position, or the boost position. By contrast, second burner stage 132 is a forced air or mechanically aspirated burner that is activated only when control knob 108 is in the boost position. In this manner, second burner stage 132 is a discretely operating (i.e., on or off) auxiliary forced air burner intended for performing high heat operation such as boiling a large pot of water. However, it should be appreciated that the primary burner and boost burner may both be incrementally regulated simultaneously or independently of each other according to alternative embodiments.

According to an exemplary embodiment, a flow rate of the flow of fuel in second branch 220 is fixed. In addition, an operating speed of fan 170 may be fixed or discrete, e.g., such that a firing rate of second burner stage 132 is fixed. Because fan 170 operates only when control knob 108 is in the boost position, fan 170 may operate at a single speed (e.g., be a single speed fan). Thus, second burner stage 132 may be more easily controlled, e.g., because gas burner assembly 120 does not require a variable speed fan and/or an encoder to track the position of control knob 108.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly positioned at the top panel, the gas burner assembly comprising one or more burner bodies defining a first plurality of flame ports, a first fuel chamber, a second plurality of flame ports, and a second fuel chamber, the first fuel chamber being in fluid communication with the first plurality of flame ports such that gaseous fuel within the first fuel chamber is flowable through the first plurality of flame ports, the second fuel chamber being in fluid communication with the second plurality of flame ports such that gaseous fuel within the second fuel chamber is flowable through the second plurality of flame ports, the first fuel chamber being separate from the second fuel chamber within the one or more burner bodies;

a dual-outlet control valve comprising a first outlet in fluid communication with the first fuel chamber for providing a first flow of the gaseous fuel and a second outlet in fluid communication with the second fuel chamber for providing a second flow of the gaseous fuel, wherein the dual-outlet control valve is movable to a boost position where the first flow of gaseous fuel is provided to the first fuel chamber at a low flow rate and the second flow of gaseous fuel is provided to the second fuel chamber;

a forced air supply source fluidly coupled to the second fuel chamber such that the forced air supply source is operable to urge a flow of air into the second fuel chamber only when the dual-outlet control valve is in the boost position;

a fuel supply circuit comprising a supply line coupled to an inlet of the dual-outlet control valve, a first branch extending from the first outlet to a first orifice positioned for directing the first flow of gaseous fuel into the first chamber, and a second branch extending from the second outlet to a second orifice positioned for directing the second flow of gaseous fuel into the second chamber, the dual-outlet control valve being configured for regulating gaseous fuel flow to the first and second branches; and a solenoid valve coupled to the second branch between the second outlet and the second orifice, wherein the solenoid valve is operably coupled to the forced air supply source and is configured to stop the second flow of gaseous fuel in the event of a failure of the forced air supply source.

2. The cooktop appliance of claim 1, wherein a flow rate of the second flow of fuel is fixed and an operating speed of the forced air supply source is fixed such that a firing rate of the second plurality of flame ports is fixed.

3. The cooktop appliance of claim 1, comprising a control knob operably coupled to the dual-outlet control valve and being rotatable in one direction to progressively adjust the dual-outlet control valve from an off position, to a lite position, to a high position, to a medium position, to a low position, and then to the boost position.

4. The cooktop appliance of claim 1, wherein the solenoid valve is normally closed and is openable in response to the dual-outlet control valve shifting to the boost position and to the forced air supply source activating.

5. The cooktop appliance of claim 1, wherein the dual-outlet control valve and the solenoid valve permit gaseous fuel flow to only the first fuel chamber when the dual-outlet control valve in not in the boost position.

6. The cooktop appliance of claim 1, wherein the first plurality of flame ports is positioned concentric with the second plurality of flame ports.

7. The cooktop appliance of claim 1, wherein the first plurality of flame ports is positioned below the second plurality of flame ports.

8. The cooktop appliance of claim 1, wherein the forced air supply source is positioned below the top panel.

9. The cooktop appliance of claim 1, wherein the first plurality of flame ports is naturally aspirated.

10. The cooktop appliance of claim 1, wherein the forced air supply source is a fan or an air compressor.

11. A gas burner assembly for a cooktop appliance, the gas burner assembly comprising:

a dual-outlet control valve for providing a flow of primary fuel out of a first outlet and a flow of boost fuel out of a second outlet;

a first burner stage that is normally aspirated and in fluid communication with the first outlet;

a second burner stage that is concentrically positioned adjacent the first burner stage and in fluid communication with the second outlet, wherein the flow of boost fuel is provided only when the dual-outlet control valve is in a boost position and when the first burner stage is operating in a low condition;

a forced air supply source fluidly coupled to the second burner stage such that the forced air supply source is operable to urge a flow of air into the second burner stage only when the flow of boost fuel is being provided; and a solenoid valve operably coupling the second outlet of the dual-outlet control valve and the second burner stage, wherein the solenoid valve is operably coupled to the forced air supply source and is configured to stop the flow of boost fuel in the event of a failure of the forced air supply source.

12. The gas burner assembly of claim 11, wherein a flow rate of the flow of boost fuel is fixed and an operating speed of the forced air supply source is fixed such that a firing rate of the second burner stage is fixed.

13. The gas burner assembly of claim 11, wherein the solenoid valve is normally closed and is openable in response to the dual-outlet control valve shifting to the boost position where the forced air supply source is activated.

14. The gas burner assembly of claim 11, wherein the dual-outlet control valve and the solenoid valve permit only the flow of primary fuel when the dual-outlet control valve in not in the boost position.

15. The gas burner assembly of claim 11, wherein the first burner stage is positioned below the second burner stage.

16. The gas burner assembly of claim 11, wherein the forced air supply source is a fan or an air compressor.

* * * * *